US009508283B2

(12) United States Patent
Choi

(10) Patent No.: US 9,508,283 B2
(45) Date of Patent: Nov. 29, 2016

(54) LIGHT EMITTING DIODE BLOCK DISPLAY DEVICE USING A USER CONTACT AND INPUT FOR ADJUSTING COLOR

(75) Inventor: Woonyong Choi, Siheung (KR)

(73) Assignee: CONSTANTEC CO., LTD., Siheung, Gyeonggi-Do (KR)

( * ) Notice: Subject to any disclaimer, the term of this patent is extended or adjusted under 35 U.S.C. 154(b) by 115 days.

(21) Appl. No.: 13/991,645

(22) PCT Filed: Jun. 17, 2011

(86) PCT No.: PCT/KR2011/004444

§ 371 (c)(1),
(2), (4) Date: Jun. 5, 2013

(87) PCT Pub. No.: WO2012/077880

PCT Pub. Date: Jun. 14, 2012

(65) Prior Publication Data

US 2013/0257923 A1 Oct. 3, 2013

(30) Foreign Application Priority Data

Dec. 7, 2010 (KR) ..... 10-2010-0123934

(51) Int. Cl.

| | |
|---|---|
| ***G09G 5/10*** | (2006.01) |
| ***G09G 3/32*** | (2016.01) |
| ***H05B 33/08*** | (2006.01) |

(52) U.S. Cl.

CPC ..... *G09G 3/32* (2013.01); *H05B 33/08* (2013.01); *G09G 2300/026* (2013.01); *G09G 2320/0666* (2013.01)

(58) Field of Classification Search

CPC ..... G09G 3/32; G09G 2320/0666; G09G 2300/026

USPC ..... 345/83, 690

See application file for complete search history.

(56) References Cited

U.S. PATENT DOCUMENTS

| | | | | |
|---|---|---|---|---|
| 2007/0247090 | A1* | 10/2007 | Kim et al. | 315/312 |
| 2008/0001526 | A1* | 1/2008 | Murakami | 313/500 |
| 2009/0090568 | A1* | 4/2009 | Min | 178/18.06 |
| 2010/0301780 | A1* | 12/2010 | Vinkenvleugel | F21V 23/04 315/362 |

FOREIGN PATENT DOCUMENTS

| | | | |
|---|---|---|---|
| CN | 101064892 | A | 10/2007 |
| CN | 101557430 | A | 10/2009 |

(Continued)

OTHER PUBLICATIONS

Japanese Notice of Allowance dated Aug. 8, 2014.

(Continued)

*Primary Examiner* — Jonathan Blancha
(74) *Attorney, Agent, or Firm* — Hauptman Ham, LLP

(57) ABSTRACT

The present invention relates to a display device using LED blocks, which includes at least one LED block having an LED installed. The LED block adjusts the color of light displayed according to the contact by the user. According to the present invention, the display device using LED blocks includes: at least one LED block including a plurality of installed color LEDs and a contact sensing unit for sensing contact by the user; and a controller for adjusting the color of light displayed by the LED block on the basis of the color data corresponding to the contact data which is generated by the contact sensing unit in accordance with contact by the user.

11 Claims, 7 Drawing Sheets

(56) References Cited

FOREIGN PATENT DOCUMENTS

| | | | |
|---|---|---|---|
| JP | 07295750 | A | 11/1995 |
| JP | 09146012 | A | 6/1997 |
| JP | 10333631 | A | 12/1998 |
| JP | 2006024039 | A | 1/2006 |
| JP | 2007133698 | | 5/2007 |
| JP | 2007300627 | A | 11/2007 |
| JP | 2010160489 | A | 7/2010 |
| KR | 200204538 | | 12/2000 |
| KR | 2020090004555 | | 5/2009 |
| KR | 1020100007140 | A | 1/2010 |

OTHER PUBLICATIONS

Chinese Office Action dated Sep. 28, 2014.
Japanese Office Action dated Apr. 11, 2014.

* cited by examiner

LIGHT EMITTING DIODE BLOCK DISPLAY DEVICE USING A USER CONTACT AND INPUT FOR ADJUSTING COLOR

CROSS REFERENCE TO RELATED APPLICATION

This application claims the priority of Korean Patent Application No. 10-2010-0123934, filed on Dec. 7, 2010 in the KIPO (Korean Intellectual Property Office of the P.R.C). Further, this application is the National Phase application of International Application No. PCT/KR2011/004444 filed Jun. 17, 2011, which designates the United States and was published in Korean.

TECHNICAL FIELD

The present invention relates to an LED block display device which includes at least one LED block having an LED and is capable of adjusting a color of light emitted from the LED block according to user contact.

BACKGROUND ART

A light emitting diode (LED) is a semiconductor device for generating light using light emission through recombination of electrons and holes. Composite semiconductors such as GaN, GaAs, GaP, GaAaP, GaAlAs, SiC, InP, and InGaP are used as a chip material of an LED. The LED has various merits such as high energy efficiency, low operation voltage, a small size, a long lifespan, and the like.

DISCLOSURE

Technical Problem

It is an aspect of the present invention to provide an LED block display device which includes at least one LED block emitting light and is capable of adjusting a color of light emitted from the LED block according to user contact.

Technical Solution

In accordance with one aspect of the present invention, an LED block display device includes: at least one LED block including a plurality of color LEDs and a contact detector for detecting user contact; a color-adjust key receiving minute adjusting data from a user; and a controller adjusting a main color of light emitted from the LED block based on color data corresponding to contact data generated by the contact detector according to user contact and controlling the LED block to emit light, a main color of which has been minutely adjusted based on the minute adjustment data, after adjusting the main color of the light.

In accordance with another aspect of the present invention, an LED block display device includes: at least one LED block including a plurality of color LEDs and a contact detector for detecting user contact; and a controller generating color data and minute adjustment data based on contact data generated by the contact detector according to user contact, adjusting a main color of light emitted from the LED block based on the color data, and controlling the LED block to emit light, a main color of which has been minutely adjusted based on the minute adjustment data, after adjusting the main color of the light.

The at least one LED block may be included in an LED block module. The LED block module may be coupled to another LED block module in a two-dimensional form. The LED block module may be coupled to other LED block modules in a three-dimensional form. The LED block display device may further include a memory storing the color data. The color data may be transferred to or from an outside, corrected, or edited. The LED block display device may further include a sound transmitter, and the controller may control the LED block to emit light, color of which has been adjusted while controlling the sound transmitter to transmit a predetermined sound. The contact data may include the number of contacts and a contact time. The contact data may include the number of contacts and a contact time. The color data may be generated based on the number of contacts and the minute adjustment data may be generated based on the contact time.

Advantageous Effects

The present invention provides an LED block display device which includes at least one LED block emitting light and is capable of adjusting a color according to user contact.

BEST MODE

Hereinafter, exemplary embodiments of the present invention will be described in detail with reference to the accompanying drawings.

Figure 1:
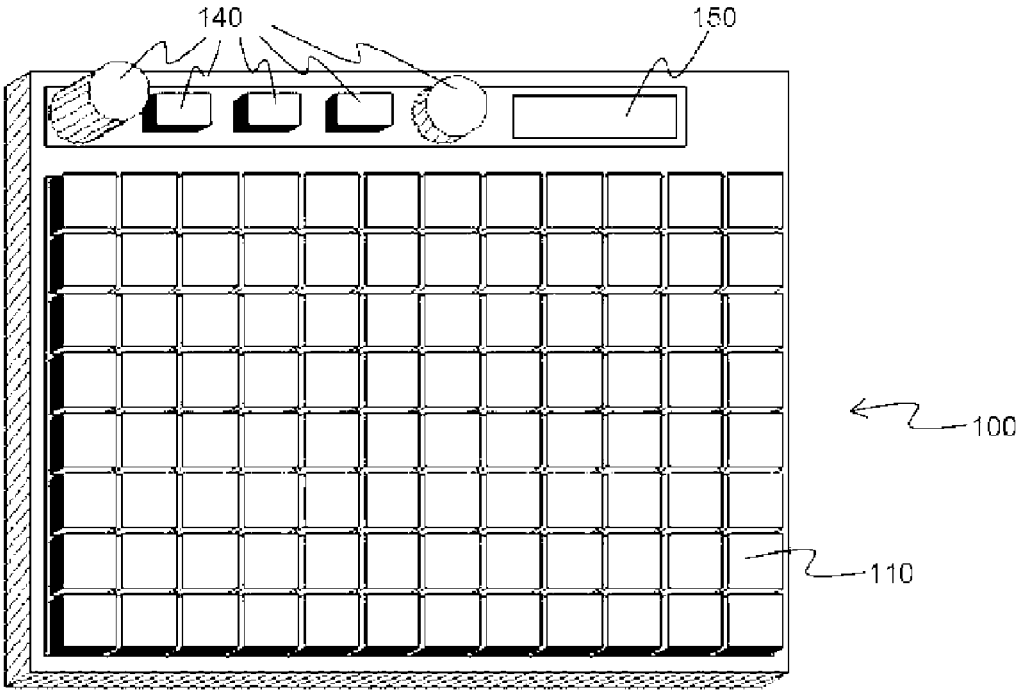
FIG. 1 is a perspective view of an LED block display device in accordance with one embodiment of the present invention.

FIG. 1 is a perspective view of an LED block display device in accordance with one embodiment of the present invention. Referring to FIG. 1, the LED block display device according to the embodiment includes at least one LED block 110, a controller (not shown), a manipulator 140, a display section 150, a battery (not shown), and a sound transmitter (not shown).

Figure 2:
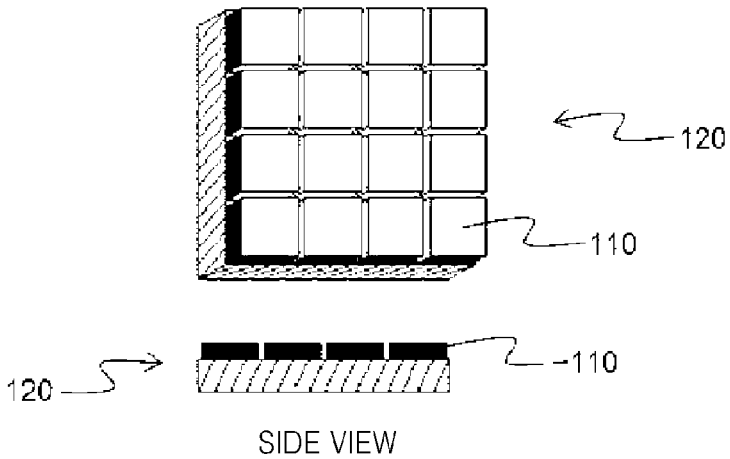
FIG. 2 shows a perspective view and a side view of an LED block module in accordance with one embodiment of the present invention.
Figure 3:
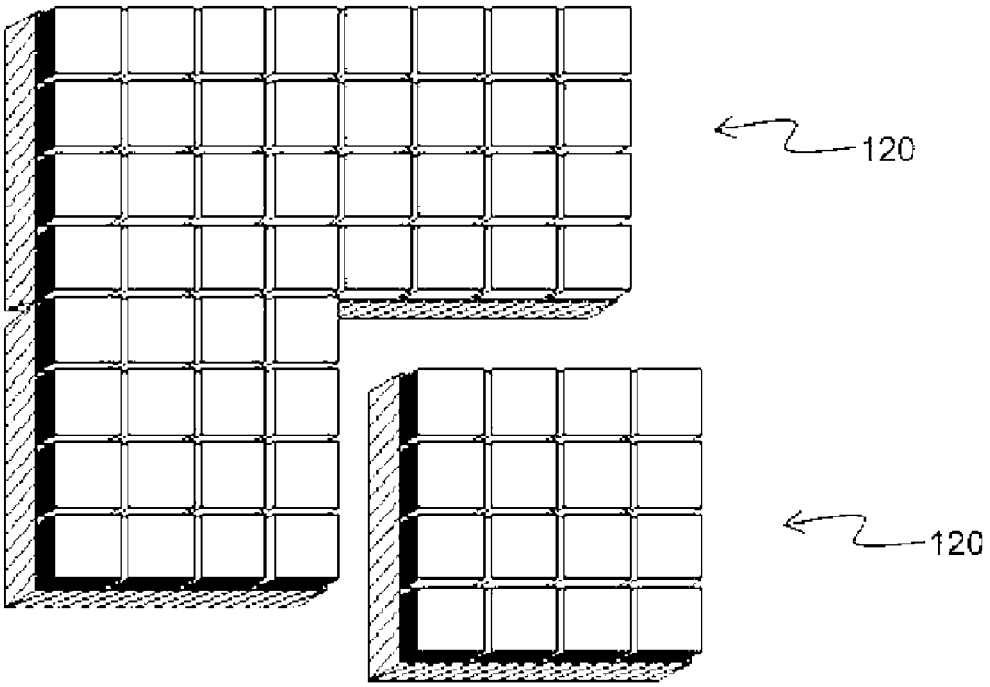
FIG. 3 is a perspective view of block modules coupled to each other in a two-dimensional form in accordance with one embodiment of the present invention.
Figure 4:
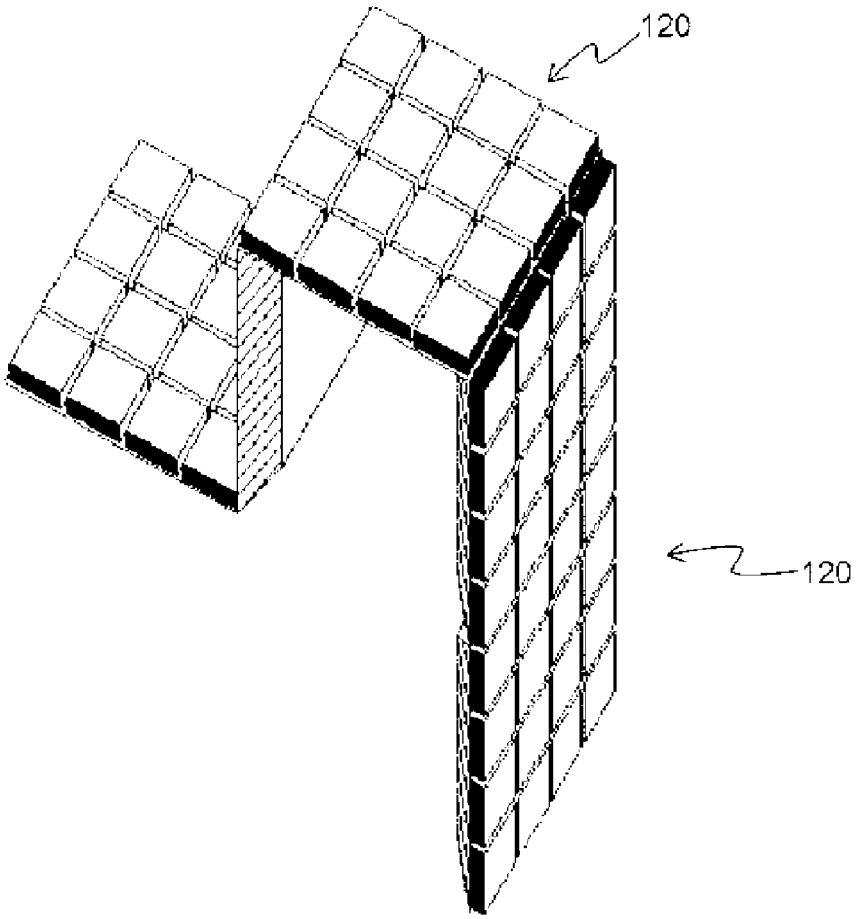
FIG. 4 is a perspective view of block modules coupled to each other in a three-dimensional form in accordance with one embodiment of the present invention.
Figure 5:
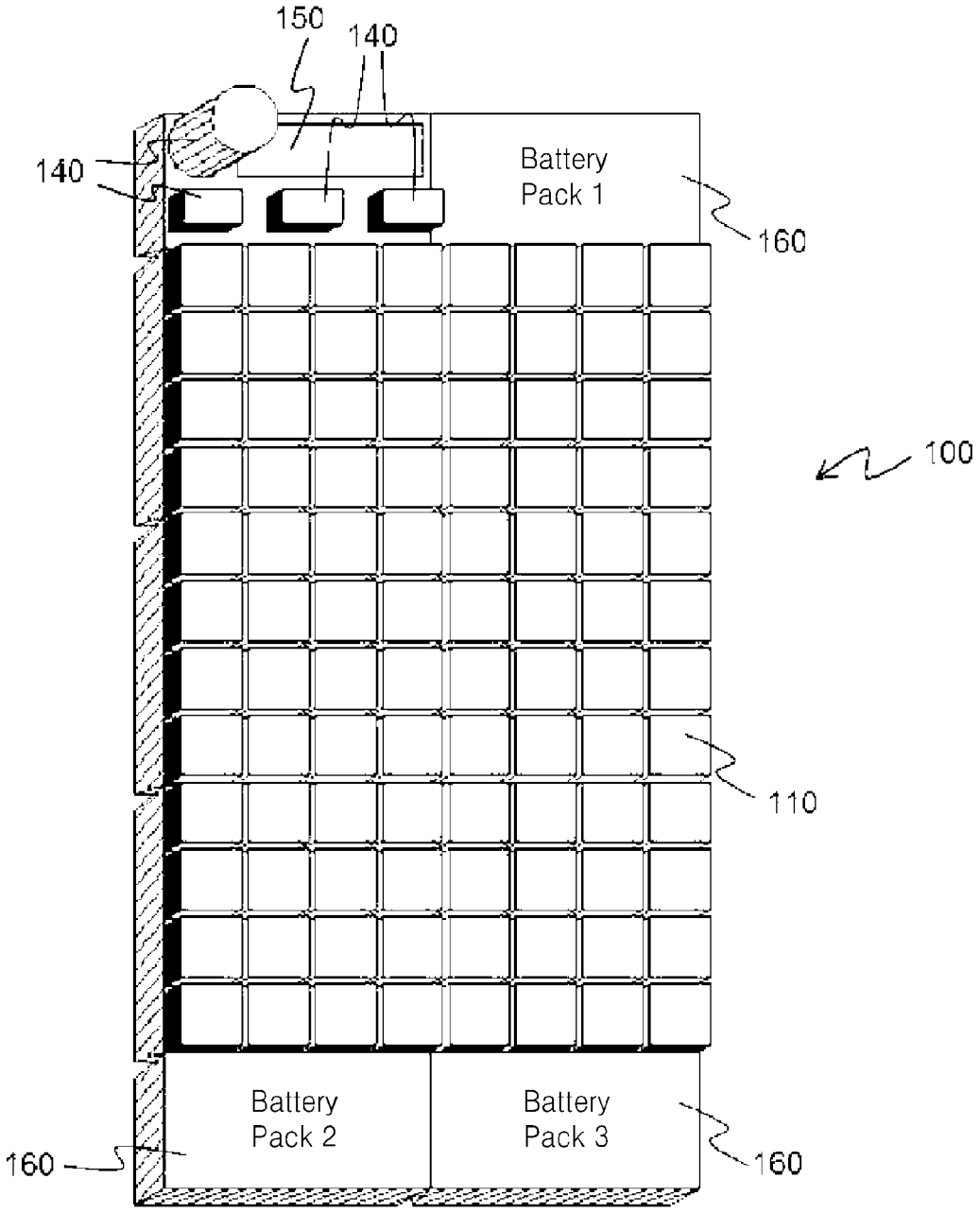
FIG. 5 is a perspective view of an LED block display device in accordance with another embodiment of the present invention.

The LED block 110 may include at least one of a red LED, a green LED, and a blue LED. It should be noted that LEDs emitting light having various colors such as yellow, amber, and violet as well as the red LED, the green LED, and the blue LED may be provided to the LED block 110 in various combinations. A contact detector (not shown) for detecting user contact is disposed in the LED block. A plurality of LED blocks 110 may be arranged to form an LED block module 120 as illustrated in FIG. 2. The LED block module 120 may be coupled to another block module 120 in a two-dimensional form as illustrated in FIG. 3, or may be coupled to other block modules 120 in a three-dimensional form as illustrated in FIG. 4.

The controller controls on/off of the LEDs disposed in the LED block 110 to adjust a color of emitted light. The manipulator 140 sends a manipulation signal of a user to the controller, and may include a plurality of buttons and a dial. The display section 150 may display manipulation information, a display state, and guide information. At least one of the manipulator 140 and the display section 150 may be omitted. The battery is a unit for applying electric power to the LED block display device according to the embodiment, and may be omitted when electric power is applied from the outside. The sound transmitter transmits a predetermined sound to the outside according to adjustment of a color of the light emitted from the LED block 110. As shown in FIG. 1, at least one of the controller, the manipulator 140, the display section 150, the battery, and the sound transmitter may be integrally formed with at least one LED block 110 or with at least one LED block module 120. In addition, at least one of the controller, the manipulator 140, the display section 150, the battery, and the sound transmitter may be manufactured separately from at least one LED block 110 or from at least one LED block module 120.

Figure 6:
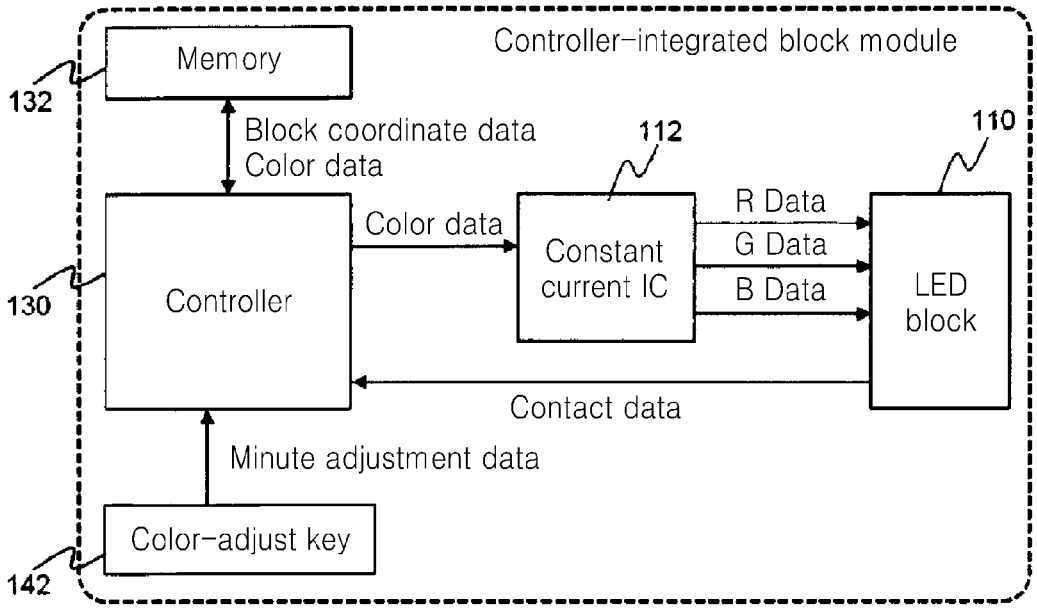
FIG. 6 is a block diagram of an LED block display device in accordance with the present invention, in which a controller and an LED block module are integrated.
Figure 7:
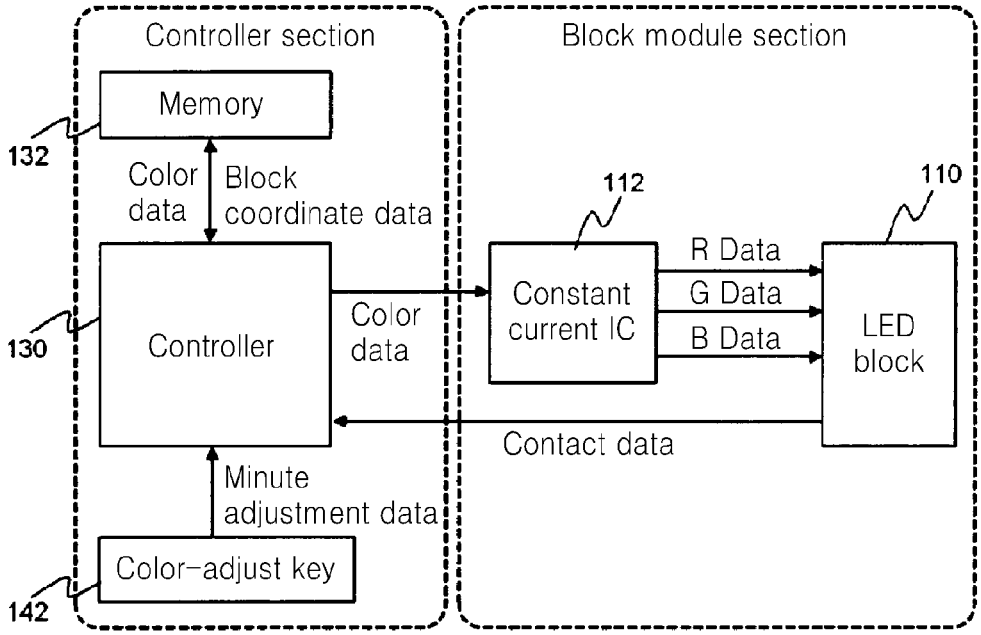
FIG. 7 is a block diagram of an LED block display device in accordance with the present invention, in which a controller and an LED block module are separated.

FIG. 6 is a block diagram of an LED block display device in accordance with the present invention, in which the controller and the LED block module are integrated. FIG. 7 is a block diagram of an LED block display device in accordance with the present invention, in which the controller and the LED block module are separated. Referring to FIGS. 6 and 7, the controller 130 may be individually placed to correspond to the individual LED block 110, may be individually placed to correspond to the individual LED block 120, may be individually placed to correspond to a plurality of LED block modules 120, or may be placed alone to correspond to the entire LED block 110. The controller 130 may receive contact data, which are detected by the contact detector when a user contacts the contact detector, from the LED block 110. The controller 130 may adjust a color of light emitted from the LED block 110 via a constant current IC 112 using color data generated based on the contact data input from the LED block 100. Although the constant current IC 112 is switched on and off in a static fashion in this embodiment, the present invention is not limited thereto and, in particular, the constant current IC 112 may be switched on and off in a dynamic fashion. The controller 130 may control the LED block 110 to emit light, color of which has been adjusted, while controlling the sound transmitter to transmit a predetermined sound to the outside. The controller 130 may control the LED block 110 to emit light, a main color of which has been minutely adjusted based on minute control data input from a color-adjust key 142 included in the manipulator 140, after adjusting the main color of the light based on the contact data. The controller 130 may adjust a main color of light based on the number of contacts according to user contact with respect to the LED block 110, and may minutely control the main color based on a contact time. The controller 130 may control the LED block 110 to emit the light, the main color of which has been minutely adjusted, while controlling the sound transmitter to transmit a predetermined sound to the outside. The LED block display device according to the embodiment may further include a memory 132. The memory 132 may be a detachable memory card. The memory 132 may be disposed in the controller 130. Color data corresponding to light emitted from the LED block 110 may be stored in the memory 132. The color data stored in the memory 132 may be corrected or edited, and may be read out by the controller 130 for use. The color data may be received from or transmitted to the outside through a communication device (not shown). When the controller 130 controls a plurality of LED blocks 110, the color data may be connected to block coordinate data regarding a location of a specific LED block 130 to be transmitted and received.

Figure 8:
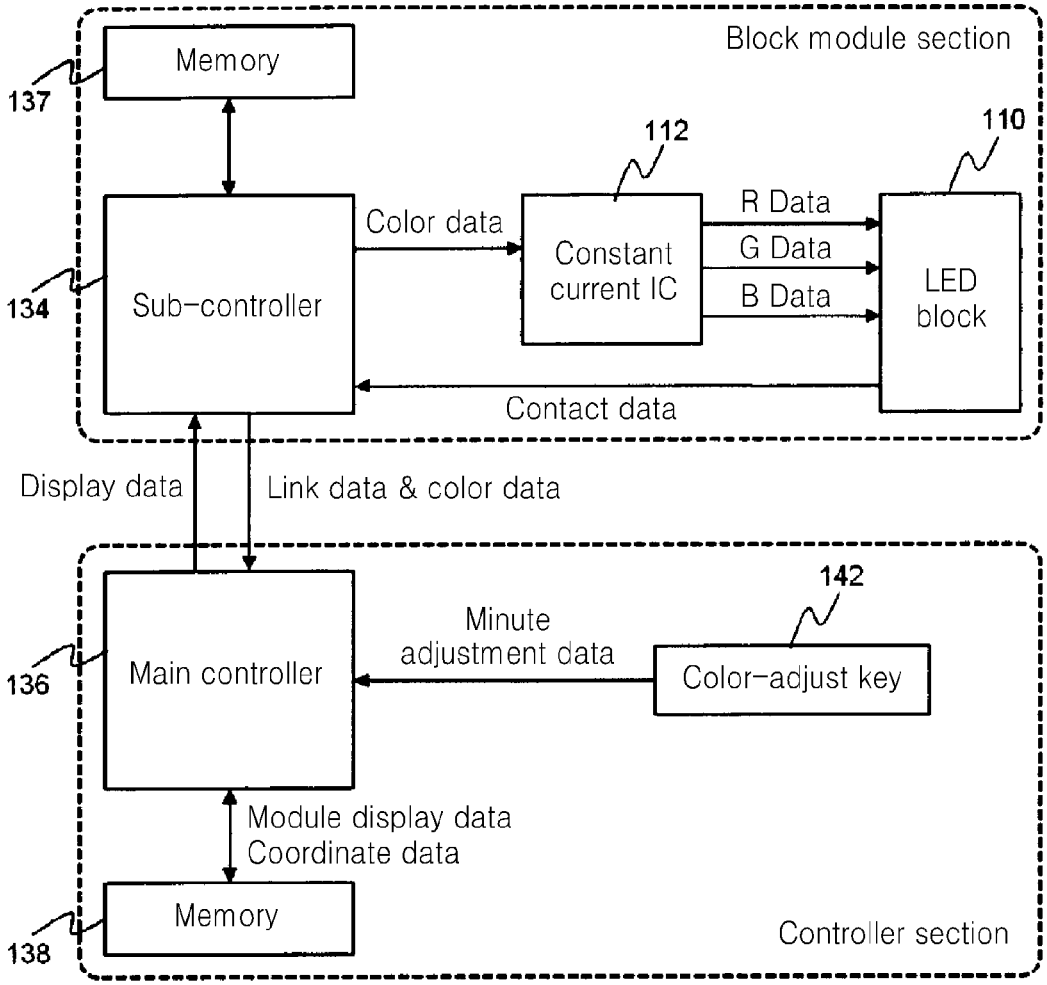
FIG. 8 is a block diagram of an LED block display device in accordance with the present invention, in which a controller and an LED block module are separated.

FIG. 8 is a block diagram of an LED block display device in accordance with the present invention, in which a controller and a LED block module are separated. Referring to FIG. 8, a sub-controller 134 for controlling an LED block module 120 for each LED block module section and a memory 137 are separately provided, and a main controller 136, a memory 138, and a color-adjust key 142 may be disposed in a control unit for controlling the entirety of the LED block module 120.

The sub-controller 134 may receive contact data, which are detected by the contact detector when a user contacts the contact detector, from the LED block 110. The sub-controller 134 may adjust a color of light emitted from the LED block 110 according to display data input from the main controller 136 via a constant current IC 112 using color data generated based on contact data input from the LED block 110. The sub-controller 134 may control the LED block 110 to emit light, color of which has been adjusted, while controlling the sound transmitter to transmit a predetermined sound to the outside. The sub-controller 134 may control the LED block 110 to emit light, a main color of which has been minutely adjusted based on minute control data input from a color-adjust key 142 included in the controller section, after adjusting the main color of the light based on the contact data. The sub-controller 134 may adjust a main color of light based on the number of contacts according to user contact with the LED block 110, and may minutely control the main color based on a contact time. The sub-controller 134 may control the LED block 110 to emit light, a main color of which has been minutely adjusted, while controlling the sound transmitter to transmit a predetermined sound to the outside. The memory 137 may be a detachable memory card. The memory 137 may be received in the sub-controller 134. Display data and/or color data corresponding to light emitted from the LED block 110 may be stored in the memory 137. The display data and/or color data stored in the memory 137 may be corrected or edited, and may be read out by the sub-controller 134 for use. The color data may be transmitted to the main controller 136 by the sub-controller 134 together with link data regarding a connection relation between the LED block modules 120.

The main controller 136 may transmit display data including content and formats displayed for each LED block module section to the sub-controllers 134 corresponding to each LED block module section. The display data may not include color data generated by the sub-controller 134 based on contact data input from the LED block 110. The display data may further include minute adjustment data input via the color-adjust key 142. The main controller 136 may connect module display data, which is display data for LED block modules, to block module coordinate data regarding a location of a specific LED block module 120 to store the data in the memory 138 or read out the data from the memory 138 for use. The main controller 136 may store display data, which is emitted from the LED block display device including at least one LED block, in the memory 138. The main controller 136 may provide a function of correcting or editing the display data emitted from the LED block display device including at least one LED block. The function of correcting or editing display data may include a function of adding various event effects to the display data. The display data, which is emitted or generated by the LED block display device according to the embodiment, may be transmitted to and from the outside through a communication device (not shown).

Figure 9:
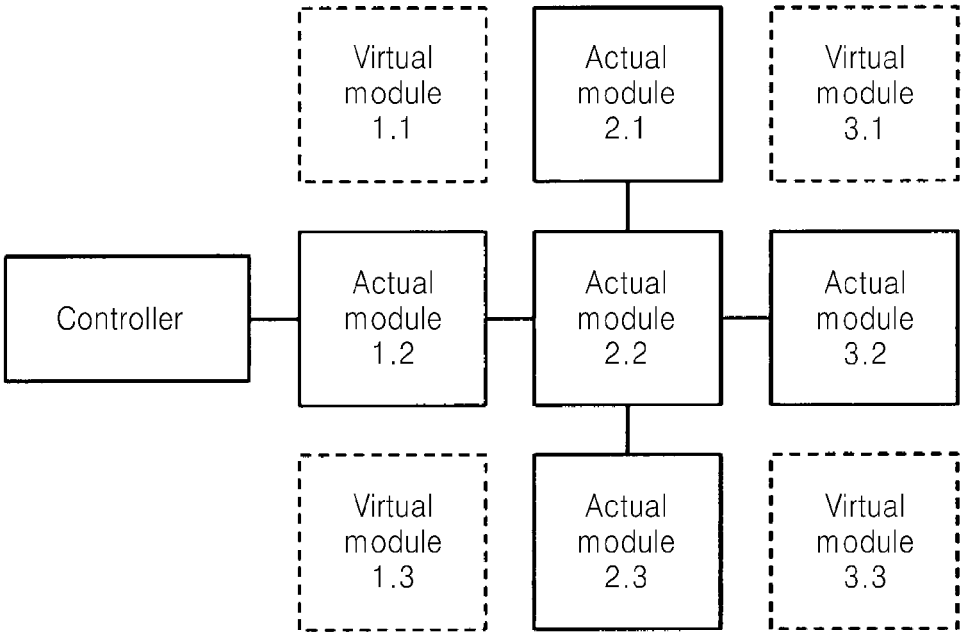
FIG. 9 is a block diagram schematically illustrating arrangement of LED block modules in accordance with one embodiment of the present invention.

FIG. 9 is a block diagram illustrating arrangement of LED block modules in accordance with one embodiment of the present invention. Referring to FIG. 9, when actual LED block modules are not arranged in a rectangular form, the controller may add a virtual LED block module to identify accurate locations of the actual LED block modules. In this embodiment, the actual LED block modules are configured to enable bidirectional communication, and may send their identification information to the controller through the communication function. The controller adds virtual LED block modules based on identification information corresponding to the actual LED block modules to dispose the actual LED block modules and the virtual LED block modules in a virtual rectangular form and identify accurate locations of the LED block modules.

INDUSTRIAL APPLICABILITY

The present invention may provide at least one LED block, which allows adjustment of a color of emitted light according to user contact, and which includes a plurality of color LEDs placed therein and a contact detector detecting user contact, and an LED block display device capable of adjusting a color of light emitted from the LED block based on color data corresponding to contact data generated by the contact detector according to user contact.

The invention claimed is:

1. A light-emitting diode (LED) block display device, comprising:

a LED block module including a plurality of LED blocks, wherein at least one LED block of the plurality of LED blocks includes a plurality of color LEDs and a contact detector configured to detect a user contact;

a color-adjust key configured to receive a minute adjusting input from a user; and a controller configured to mainly adjust a color of light emitted from the LED block to be a first color, based on main color data corresponding to contact data generated by the contact detector based on the user contact, wherein the first color is one color or mixed color selected from the group consisting of red, green, blue, yellow, amber, and violet, and minutely adjust the mainly adjusted color of light emitted from the LED block to be a second color, based on minute color data corresponding to minute adjusting data generated based on the minute adjusting input, wherein the second color is a color within a color range of the first color, wherein the contact data comprises a number of contacts with the at least one LED block, and a duration of the minute adjusting input which is a contact with the at least one LED block, wherein the main color data are generated based on the number of contacts with the at least one LED block, wherein the minute adjusting data are generated based on the duration of the minute adjusting input, and wherein the main color data and the minute color data are connected to block coordinate data regarding a location of a LED block to be transmitted and received with the block coordinate data.

2. The LED block display device according to claim 1, wherein the LED block module is coupled to another LED block module in a two-dimensional form or a three-dimensional form.

3. The LED block display device according to claim 1, further comprising:

a memory configured to store the main and minute color data.

4. The LED block display device according to claim 3, wherein the main and minute color data are capable of being transferred to or from an outside, corrected, or edited.

5. The LED block display device according to claim 1, further comprising:

a sound transmitter configured to transmit a predetermined sound, wherein the controller is configured to control the LED block to emit light with the minutely adjusted color, while controlling the sound transmitter to transmit the predetermined sound.

6. A light-emitting diode (LED) block display device, comprising:

a LED block module including a plurality of LED blocks, wherein at least one LED block of the plurality of LED blocks includes a plurality of color LEDs and a contact detector configured to detect a user contact; and a controller configured to generate main color data based on contact data generated by a contact detector based on the user contact, generate minute color data based on minute adjusting data generated based on a minute adjusting input from a user, and mainly adjust a color of light emitted from the LED block to be a first color, based on the main color data, wherein the first color is one color or mixed color selected from the group consisting of red, green, blue, yellow, amber, and violet, and minutely adjust the mainly adjusted color of light emitted from the LED block to be a second color, based on the minute color data, wherein the second color is a color within a color range of the first color, wherein the contact data comprises a number of contacts with the at least one LED block, and a duration of the minute adjusting input which is a contact with the at least one LED block, wherein the main color data are generated based on the number of contacts with the at least one LED block, wherein the minute adjusting data are generated based on the duration of the minute adjusting input, and wherein the main color data and the minute color data are connected to block coordinate data regarding a location of a LED block to be transmitted and received with the block coordinate data.

7. The LED block display device according to claim 6, wherein the LED block module is coupled to another LED block module in a two-dimensional form.

8. The LED block display device according to claim 6, wherein the LED block module is coupled to other LED block modules in a three-dimensional form.

9. The LED block display device according to claim 6, further comprising:

a memory configured to store the main and minute color data.

10. The LED block display device according to claim 9, wherein the main and minute color data are capable of being transferred to or from an outside, corrected, or edited.

11. The LED block display device according to claim 6, further comprising:

a sound transmitter configured to transmit a predetermined sound, wherein the controller is configured to control the LED block to emit light with the minutely adjusted color, while controlling the sound transmitter to transmit the predetermined sound.

* * * * *